US006214521B1

(12) United States Patent
Telser et al.

(10) Patent No.: US 6,214,521 B1
(45) Date of Patent: Apr. 10, 2001

(54) MATERIAL FOR GRAVURE RECORDING BY MEANS OF COHERENT ELECTROMAGNETIC RADIATION AND PRINTING PLATE THEREWITH

(75) Inventors: Thomas Telser, Weinheim; Uwe Stebani, Flörsheim-Dalsheim; Hartmut Sandig, Frankenthal; Klaus-Dieter Tensierowski, Hirschberg, all of (DE)

(73) Assignee: BASF Drucksysteme GmbH, Stuttgart (DE)

( * ) Notice: Subject to any disclaimer, the term of this patent is extended or adjusted under 35 U.S.C. 154(b) by 0 days.

(21) Appl. No.: 09/382,149

(22) Filed: Aug. 24, 1999

(30) Foreign Application Priority Data

Aug. 24, 1998 (DE) ..... 198 38 315

(51) Int. Cl.[7] ..... G03C 1/73

(52) U.S. Cl. ..... 430/281.1; 430/286.1; 430/905; 430/913; 430/909; 430/307; 430/306

(58) Field of Search ..... 430/270.1, 281.1, 430/286.1, 905, 913, 909, 300, 306, 307

(56) References Cited

U.S. PATENT DOCUMENTS

| | | | | |
|---|---|---|---|---|
| 4,272,611 | | 6/1981 | Vyvial et al. | 430/306 |
| 4,292,152 | | 9/1981 | Lechtken et al. | 204/159 |
| 4,517,277 | * | 5/1985 | Lynch et al. | 430/281 |
| 4,551,415 | * | 11/1985 | Cohen et al. | 430/281 |
| 5,262,476 | * | 11/1993 | Laughner | 525/67 |
| 5,344,744 | * | 9/1994 | Ueda et al. | 430/287 |
| 5,563,023 | * | 10/1996 | Kangas et al. | 430/273.1 |

FOREIGN PATENT DOCUMENTS

| | | |
|---|---|---|
| 224164 | 6/1987 | (EP) . |
| 767406 | 4/1997 | (EP) . |

OTHER PUBLICATIONS

Brandrup et al., *Polymer Handbook*, 3rd ed., 1989, pp. 316–322.

* cited by examiner

*Primary Examiner*—Janet Baxter
*Assistant Examiner*—Yvette M. Clarke
(74) *Attorney, Agent, or Firm*—Keil & Weinkauf

(57) ABSTRACT

A material for gravure recording by means of coherent electromagnetic radiation for letterpress printing, consisting of a substrate and a crosslinkable layer, with or without a release layer and/or cover sheet, the layer containing at least one ethylenically unsaturated compound, a polymerization initiator and at least one polymeric binder which consists of polyvinyl alcohol and/or at least one copolymer having a substantial proportion of the structural unit and containing a filler having a ceiling temperature of less than 800K, in particular less than 600K, e.g. polystyrene, polymethyl methacrylate, poly(ethylene)ketone, polyoxymethylene or poly(α-methylstyrene), in particular having a spherical or roughly spherical form with a maximum dimension of about 5–10 μm. The material is very suitable for laser-engravable letterpress printing plates.

10 Claims, 4 Drawing Sheets

MATERIAL FOR GRAVURE RECORDING BY MEANS OF COHERENT ELECTROMAGNETIC RADIATION AND PRINTING PLATE THEREWITH

The present invention relates to a material for gravure recording by means of coherent electromagnetic radiation, consisting of a substrate, a crosslinkable layer, optionally a release layer and optionally a cover sheet, the crosslinkable layer containing at least one ethylenically unsaturated compound and a polymerization initiator and at least one polymeric binder which consists of a polyvinyl alcohol having a degree of hydrolysis of 50–99% and/or one or more copolymers which have a significant proportion of the structural unit

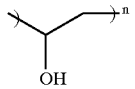

Such materials are known for printing plates for letterpress printing.

WO 93/23252 describes a process for laser gravure recordings on an elastomeric one-layer flexographic printing plate, where mechanical, photochemical or thermochemical strengthening of the one-layer material and engraving with a selected pattern are to be effected for the production of the completely engraved flexographic printing plate. The one-layer material contains reinforcing agents which are to act mechanically and/or thermochemically and/or photochemically. Such reinforcing agents are advantageous for rubber-like flexographic materials, for improving the gravure with respect to higher image resolution for the printing of packaging. Mechanical reinforcing agents used are radiation-absorbing pigments, for example finely divided metal particles, such as aluminum, copper or zinc, alone or in combination with carbon black, graphite, copper chromite, chromium oxide, cobalt-chromium-aluminum and other dark, inorganic pigments. Further reinforcing agents which may be mentioned are: various synthetic or natural fibers, e.g. cellulose, cotton, cellulose acetate, viscose, paper, glass wool, nylon and polyester. Such mechanical reinforcing agents cannot be used for crosslinkable PVA binders for letterpress printing plates.

Owing to the large amount of energy produced and its reliability, the $CO_2$ laser permits a good material removal rate during the gravure process.

The use of solid-state lasers, in particular of neodymium-YAG lasers, is also known and has the advantage of 10 times better resolution, since the wavelength is about 1 $\mu$m, and the disadvantage of a lower removal rate owing to the fact that the performance is lower with a highly focused beam.

EP-A 767 406 discloses an IR laser process for the ablation of an IR-sensitive layer for the production of a mask for imagewise UV exposure of a letterpress printing plate. Production of a mask in this manner differs in principle from the gravure of a printing plate.

It is an object of the present invention to provide material for gravure recording for letterpress printing plates, with which recordings or printing products having high resolution can be produced in a short time by means of coherent electromagnetic radiation.

We have found that this object is achieved, according to the invention, by a material for gravure recording, by means of coherent electromagnetic radiation, consisting of a substrate, a crosslinkable layer, optionally a release layer, and optionally a cover sheet, the crosslinkable layer containing at least one ethylenically unsaturated compound and a polymerization initiator and at least one polymeric binder which consists of a polyvinyl alcohol having a degree of hydrolysis of from 50 to 99% and/or one or more copolymers which have a significant portion of the structural unit

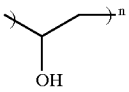

and a polymeric filler which has a ceiling temperature of less than 800K, and in particular less than 600K, is additionally provided.

(Ceiling temperature is understood as meaning the temperature at which the depolymerization of a macromolecule begins from the chain end.)

The particular advantage of using the filler having a specified ceiling temperature limit is that the material is surprisingly suitable for letterpress printing and the gravure rate can be significantly increased without sacrificing the printing quality.

Figure 1:
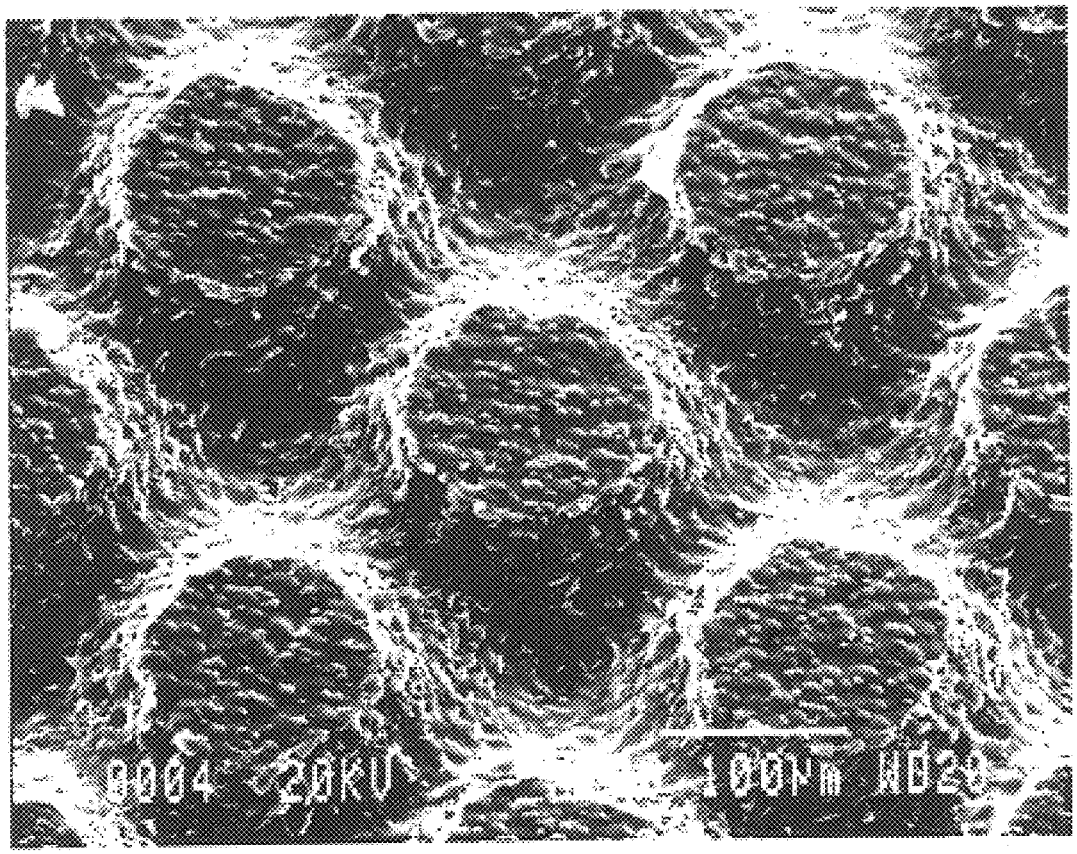
FIGS. 1 and 2 show relief views of laser gravure plates according to the invention.

In a further embodiment, the filler may be crosslinkable or crosslinked or uncrosslinked; expediently, the filler may be one or more of the following polymers:

polystyrene (PS), polymethyl methacrylate (PMMA), poly(ethylene)ketone, polyoxymethylene (POM), polytetrahydrofuran or poly(ψ-methylstyrene). It is surprisingly advantageous if the filler is present in particulate form, in particular in spherical form or roughly spherical form, the maximum dimension being about 5–10 $\mu$m.

In a further embodiment, the polymeric filler can be used in an amount of from 1 to 49.9%, in particular from 2 to 25%, preferably from 5–15%, based on the solid of the crosslinkable layer B).

It is also surprisingly advantageous if the polymeric filler has a ceiling temperature of less than 500K and in particular consists of polymethyl methacrylate (PMMA) or of polyoxymethylene (POM).

The crosslinkable layer B) is expediently crosslinkable photochemically (actinic radiation), thermally or by means of an electron beam before the gravure recording.

The crosslinkable layer B) may also have a multi-stratum form, at least one engravable material layer which, in addition to the at least one polymer binder B3), contains a polymeric filler B4) having a ceiling temperature of less than 800K, in particular less than 600K, being provided.

Expediently, one or more additives, e.g. colorants, stabilizers or plasticizers, may be incorporated into the novel material.

The coherent electromagnetic radiation for gravure recording is expediently laser radiation, in particular the radiation of a $CO_2$ laser. By specific control and formation of the laser beam, it is possible to adapt the quality of the letterpress relief to the letterpress-specific printing requirements for improving the printing characteristic in halftone printing.

In terms of preparation, it is advantageous for the gravure material if the filler B4) is added in the form of precrosslinked or uncrosslinked polymer beads having diameters of about 5–10 μm to the binder B3). The size is preferably below the desired resolution of the fine relief elements of the printing relief.

High-quality printing plates having the following parameters can be produced using the novel gravure material.

In a printing plate comprising a novel material and a laser gravure produced by means of a $CO_2$ laser having a wavelength of 10,640 nm and a power of more than 100 W at a focal diameter of about 15 μm, the shadow well depths are from about 15 to about 50 μm, in particular from about 24 to about 45 μm, in the case of a halftone gravure of the printing plate. The printing products produced therewith thus meet the highest requirements of the printing industry. A printing plate having a novel material comprises a filler which is contained as particles and/or beads in the crosslinked layer B).

Binders for the gravure material are polyvinyl alcohol having a degree of hydrolysis of 50–99% and/or copolymers of polyvinyl alcohol having the structural unit mentioned in claim 1. The preparation and the use of such polyvinyl alcohols and/or copolymers are described in the examples. In addition, polymeric binders which contain at least one reactive group which can participate in a chemical reaction for crosslinking the recording layer may also be advantageously used. Also suitable are reactive groups in the side chain of a branched homo- or copolymer, or reactive groups subsequently introduced into the polymer by means of a polymer-analogous modification, as described, for example, in EP-A 0079514, EP-A 0224164, or EP-A 0059988, the first two publications describing binders, a polyvinyl alcohol derivative and a polyalkylene oxide/vinyl ester graft copolymer having vinyl alcohol and vinyl ester structural units, respectively, and the last publication describing an acylphosphine oxide compound as a photoinitiator for photopolymerizable recording materials.

Materials comprising said polymers or mixtures thereof which are crosslinked are preferred. The crosslinking can be effected by a chemical reaction, for example a free radical, ionic or coordination polymerization, a polycondensation or a polyaddition reaction. The crosslinking reaction may be initiated photochemically or thermally, if required also carried out with the aid of a low molecular weight compound having reactive groups and/or of a suitable initiator or by means of an electron beam.

The preparation of the material for gravure recording before the laser gravure process can be effected by one of the known preparation processes, for example casting of a solution of the polymers and, if required, other starting materials from a suitable solvent or solvent mixture or by extrusion.

The filler polymers which are most suitable according to the invention should have a ceiling temperature of <800K, preferably <600K, particularly preferably <500K. The claimed polymers have the following ceiling temperatures:
polystyrene Tc=583K
polymethyl methacrylate (PMMA) Tc=493K
poly(ethylene)ketone Tc=423K
poly(α-methylstyrene) Tc=334K
polyoxymethylene (POM) Tc=392K However, other polymers are also suitable provided that they fulfill the ceiling temperature criterion and can be incorporated into the PVA binders. It has proven particularly advantageous—as also explained below in the examples—to use as a polymeric filler one which has a ceiling temperature of <500K, i.e. in particular PMMA and POM.

The following were used as sources of the ceiling temperatures:

1) Branderup, Immerguth, Polymer Handbook, 3rd edition, chapter II, page 316
2) B. Tieke, Makromolekulare Chemie—Eine Einfuhrung,. Weinheim, VCH 1997, page 84 et seq.)

EXAMPLES

Gravure conditions for all materials from Examples 1–5 and Comparative Example 1:

$CO_2$ laser, wavelength λ=10,640 nm

Power: 130 W, Focus: 21 μm, Screen ruling 48–60 lines/m

Laser feed: 0.021 mm (TrueScreen program from Baasel-Scheel Grapholas.)

For the experiments, the material was supplied to rolls having a theoretical circumference of 40 cm and, depending on the material, said rolls were rotated at circumferential speeds of about 55/110/165/220 rpm for laser engraving. For each experiment, focusing of the laser beam on the material surface was readjusted.

COMPARATIVE EXAMPLE 1C

Material prepared from 80 parts by weight of a partially hydrolyzed poly(vinyl acetate) subsequently functionalized by a polymer-analogous reaction (for example described in EP-A 0079514, EP-A 0224164, or EP-A 0059988), 70 parts by weight of a copolymer of vinyl alcohol and ethylene glycol (for example described in DE 28 46 647 A1) and 90 parts by weight of a partially hydrolyzed polyvinyl alcohol (KP 405 from Kuraray co. Ltd., Japan), which are dissolved in a mixture of 150 parts by weight of water and 150 parts by weight of n-propanol at 85° C. and stirred until homogeneous solution has formed. Thereafter, 34 parts by weight of a polyurethane acrylate, as an ethylenically unsaturated compound, 3 parts by weight of benzil dimethyl ketal, as an initiator, 0.2 part by weight of the potassium salt of N-nitrosocyclohexalhydroxylamine, as a thermal inhibitor, and 0.005 part by weight of Safranine T (C.I. 50240), as a dye, are added and stirring is carried out at 85° C. until a homogeneous solution has formed. The solution is brought to a solids content of 40% and then cast on a film substrate in a manner such that, after drying, a 600 μm thick photosensitive layer is obtained. This material is laminated with a coated PET film and the layer thus obtained and having a total thickness of 1050 μm is dried for 3 hours at 60° C. in a drying oven. The photosensitive layer is then exposed for 20 minutes to UV light and thus crosslinked. The crosslinked material is finely engraved under said conditions with a $CO_2$ laser.

| | |
|---|---|
| Gravure rate: | 55.84 rpm |
| Result: | see Table 1 |
| Rating: | Excellent printed copies, but the long gravure time of 120 minutes is disadvantageous. |

EXAMPLE 2

Crosslinked material according to Comparative Example 1C additionally contains 5% by weight of crosslinked PMMA beads having a mean particle diameter of about 5 μm, e.g. AgfaPearl ®×5000 from Agfa-Gevaert AG, having a special dispersing coating. AgfaPearl® is a registered trademark of Agfa-Gevaert AG, Leverkusen.

| | |
|---|---|
| Gravure rate: | 111.68 rpm |
| Result: | see Table 1 and SEM, FIG. 1 Shadow well depth at 50% tonal value about 39 μm (at 223.36 rpm about 18 μm) |
| Rating: | Excellent printed copies, slightly longer gravure time of 60 minutes compared with conventional production. |

EXAMPLE 3

Crosslinked material according to Comparative Example 1C additionally contains 10% by weight of crosslinked PMMA beads having a mean particle diameter of about 5 μm.

Figure 2:
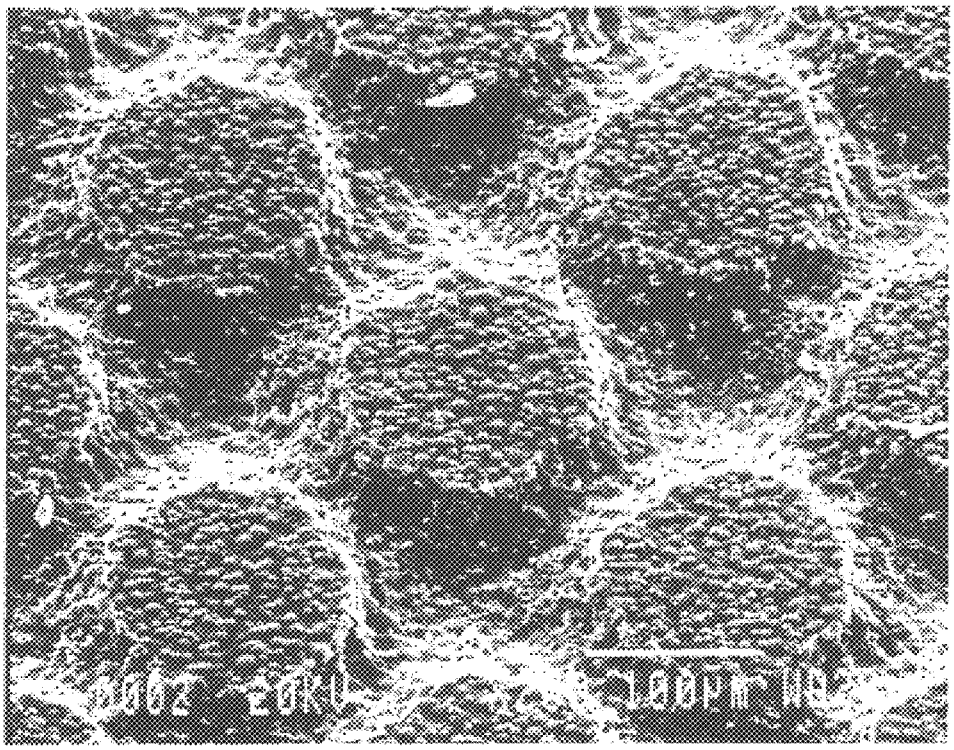

| | |
|---|---|
| Gravure rate: | 223.36 rpm |
| Result: | see Table 1 and SEM, FIG. 2 Shadow well depth at 50% tonal value about 24 μm (at 111.68 rpm about 45 μm) |
| Rating: | Excellent printed copies, production time of 30 minutes even substantially shorter than conventional method |

FIGS. 1 and 2 show greatly magnified relief views of laser gravure plates according to the invention, which were engraved at different roll speeds.

EXAMPLE 3A

A crosslinked material according to Comparative Example 1C additionally contains 10% by weight of uncrosslinked POM particles having a mean maximum particle dimension of about 5 μm. The POM material used is Ultraform N 2520 X L2 from Ultraform GmbH, Ludwigshafen, containing conductive carbon black in granular form. The granules are very finely milled in a ball mill and the milled material is then sieved to an average particle size of about 5 μm before introduction into the crosslinkable layer B) of the material. The gravure of the prepared material is carried out using an Nd: YAG laser having a wavelength of 1064 nm, from Baasel-Scheel. The focal diameter of the IR beam is brought to 20 μm.

Gravure rate: 111.68 rpm

Result: see Table

| | |
|---|---|
| Rating: | Good printed copies with very small tonal value increase in short production time. |

EXAMPLE 4

Material according to Comparative Example 1C except that the solution is not applied to a film and dried. Instead, a cylinder, for example consisting of a glass fiber-reinforced plastics core and a PU outer layer, is coated with the solution and the cylinder thus provided with a photosensitive layer is dried for three hours at 60° C. in a drying oven. The photosensitive layer is then exposed to UV light for 20 minutes and thus crosslinked. The crosslinked material is finally engraved using a $CO_2$-laser under said conditions.

| | |
|---|---|
| Result: | see Table 1 |
| Rating: | Excellent printed copies, very short production time of 40 minutes. |

EXAMPLE 5

Material prepared from 55 parts by weight of a copolymer of vinyl alcohol and ethylene glycol (for example described in DE 28 46 647 A1), 8 parts by weight of a plasticizer suitable for polyvinyl alcohol, such as polyethylene glycol (e.g. Pluriol E 400 from BASF AG), 24 parts by weight of a phenyl glycidyl ether acrylate as an ethylenically unsaturated compound, 10 parts by weight of crosslinked PMMA beads having a mean particle diameter of about 5 μm, 2 parts by weight of benzil dimethyl ketal as an initiator, 0.2 parts by weight of the potassium salt of N-nitrosocyclohexylhydroxylamine as a thermal inhibitor and 0.005 part by weight of Safranine T (C.I 50240) as a dye, which, when melted in an extruder and applied as a homogeneous melt at 145° C. to give a suitable coating, gives a photosensitive layer of 800 μm. The photosensitive layer is then exposed to UV light for 20 minutes and thus crosslinked. The crosslinked material is finally engraved using a $CO_2$ laser under said conditions.

| | |
|---|---|
| Result: | see Table 1 |
| Rating: | excellent printed copies, very short production time of 35 minutes. |

COMPARATIVE EXAMPLE V1

Material prepared from 55 parts by weight of a polyamide, which is dissolved in a mixture of 10 parts by weight of water and 90 parts by weight of methanol at 60° C. and stirred until a homogeneous solution has formed. Thereafter, 30 parts by weight of a bis(N-methylolacrylamido)ethylene glycol ether, as an ethylenically unsaturated compound, 2 parts by weight of benzil dimethyl ketal, as initiator, 0.2 part by weight of the potassium salt of N-nitrosocyclohexylhydroxylamine, as a thermal inhibitor, and 0.01 part by weight of Neozapon Black, as a dye, are added and stirring is carried out at 60° C. until a homogeneous solution has formed. This solution is brought to a solids content of 45% and then cast on a film substrate in a manner such that, after drying, a 600 μm thick photosensitive layer results. This material is laminated with a coated PET film and the layer thus obtained and having a total thickness of 1050 μm is dried for 3 hours at 60° C. in a drying oven. The photosensitive layer is then exposed to UV light for 20 minutes and thus crosslinked. The crosslinked material is finally engraved using a $CO_2$ laser under said conditions.

| | |
|---|---|
| Result: | see Table 1 |
| Rating: | material melts during the gravure process, molten material thrown up in the form of craters remains behind, unusable printed copies |

COMPARATIVE EXAMPLE V2

Material prepared from 27 parts by weight of a partially hydrolyzed poly(vinyl acetate) subsequently functionalized by a polymer-analogous reaction (for example, described in EP-A 0079514, EP-A 0224164, or EP-A 0059988) and 35 parts by weight of a copolymer of vinyl alcohol and ethylene glycol (for example, described in DE 28 46 647 A1), which are dissolved in a mixture of 70 parts by weight of water and 30 parts by weight of n-propanol at 85° C. and stirred until a homogeneous solution has formed. Thereafter, 34 parts by a polyurethane acrylate, as an ethylenically unsaturated compound, 3 parts by weight of N-nitrosocyclohexylhydroxalamine, as an initiator, and 0.005 part by weight of Safranine T (C.I. 50240), as a dye, are added and stirring is carried out at 85° C. until a homogeneous solution has formed. This solution is brought to a solids content of 40% with a mixture of 60 parts by weight of water and 40 parts by weight n-propanol and then cast on a film substrate in a manner such that, after drying, a 600 $\mu$m thick photosensitive layer results. This material is laminated with a coated PET film and the layer thus obtained and having a total thickness of 1050 $\mu$m is dried for three hours at 60° C. in a drying oven. The photosensitive layer is exposed through a test negative in a UV vacuum exposure unit (Nyloprint exposure unit 80×107) and washed out with water (Nyloprint washout system DW 85).

Figure 3:
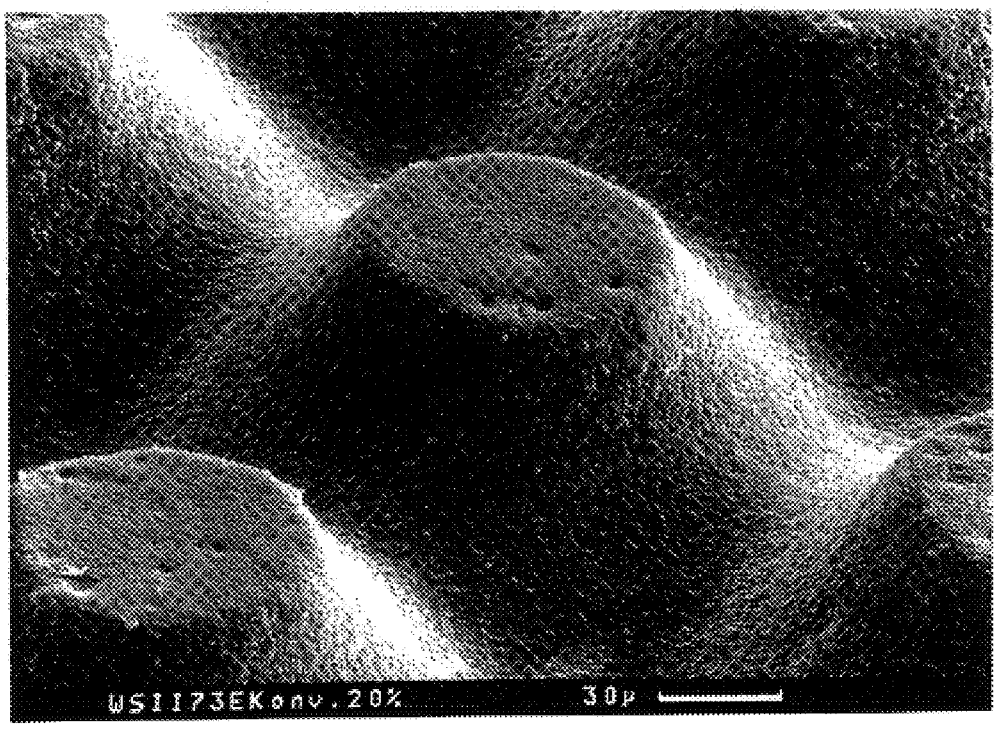
FIGS. 3 and 4 show scanning electron relief micrographs of printing reliefs.

| | |
|---|---|
| Result: | see Table 1 and SEM, FIG. 3 |
| Rating: | good printed copies |

Figure 4:
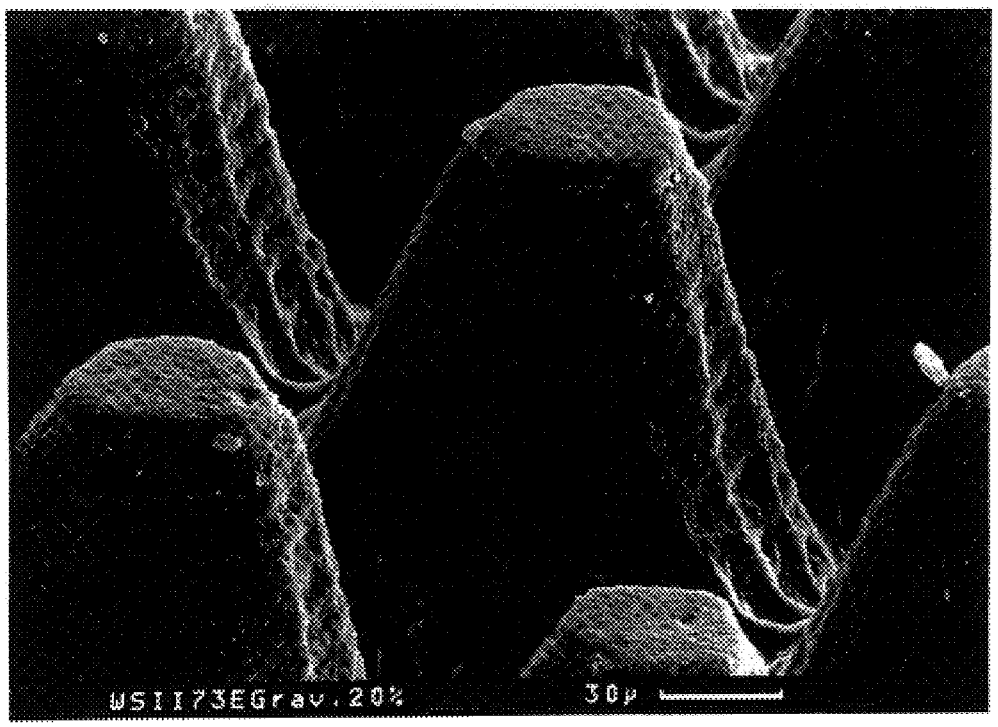

In comparison with a printing plate produced conventionally by the Nyloprint® process and shown in FIG. 3, FIG. 4 shows a laser-engraved printing plate according to the invention, having the same characteristics of 48 lines/cm screen ruling and 20% of tonal value.

NYLOPRINT ® is a registered trademark of BASF Drucksysteme GmbH, Stuttgart.

TABLE 1

| Ex. | Binder | Filler [wt. -%] | Laser source | Gravure result | Time required* [min] | Printed copy |
|---|---|---|---|---|---|---|
| 1C | PVA | 0 | $CO_2$ | ++ | 120 | ++ |
| 2 | PVA | 5 | $CO_2$ | ++ | 60 | ++ |
| 3 | PVA | 10 | $CO_2$ | ++ | 30 | ++ |
| 3A | PVA | 10 | Nd:YAG | + | 40 | + |
| 4 | PVA | 10 | $CO_2$ | ++ | 30 | ++ |
| 5 | PVA | 10 | $CO_2$ | ++ | 35 | ++ |
| V1 | PA | 0 | $CO_2$ | −− | 60 | −− |
| V2 | PVA | 0 | conv. | n.g. | 45 | + |

*measured on a test file in DIN A4 format
Rating: ++ = excellent; + = good; −− = unusable
conv.: conventional plate production
n.g.: no gravure means UV exposure, washout and drying of a standard Nyloprint plate.

Printing relief production by gravure recording by means of a laser a) Starting material is of photopolymeric letterpress printing plate, e.g. Nyloprint plate having the following structure: Substrate material: steel or aluminum sheet or film, e.g. polyester, which was bonded to the Nyloprint polymer layer by means of an adhesion-promoting layer. The plastics layer is completely crosslinked.

b) Production of the printing relief by means of a $CO_2$ laser having a power of up to 130 W. The halftone gravure is controlled by means of special data programs in the laser unit.

The control of the tonal value range and of the dot structure of the Nyloprint plates for achieving optimum tonal value transfer in letterpress printing and dry offset is effected by the difference in the DTP files.

c) Advantages of laser gravure over conventional Nyloprint plate production: the negative lines and dots of the high tonal values are open and the shadow well depths of the relief are deeper compared with data transfer by film. Consequently, the closing up of halftone shadow well depths and fine negative line work in the print is substantially reduced, particularly in dry offset (letterset): the effects in the plate, such as dust occlusions and vacuum errors in the conventional method, are avoided.

Figure 5:
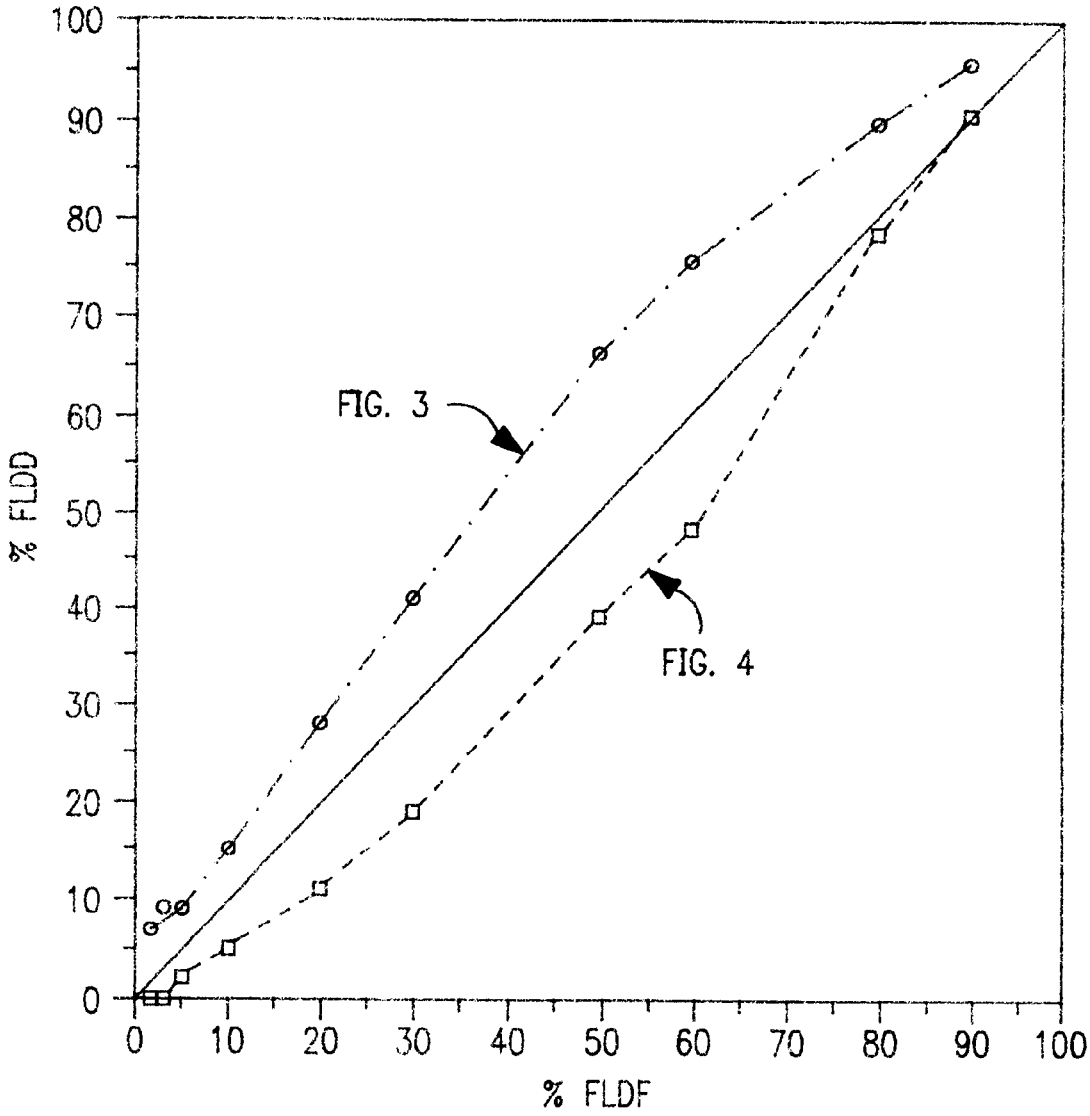
FIG. 5 shows a print comparison diagram.

FIG. 5 shows a print comparison diagram and FIG. 3 and 4 show scanning electron relief micrographs (SEM) of conventionally produced and laser-engraved printing reliefs. Specifically they show the following:

FIG. 3 shows, in highly magnified form, the relief surface of a ready-to-print Nyloprint plate which was exposed through a photographic transparency. FIG. 4 shows for comparison the ready-to-print relief surface of a letterpress printing plate laser-engraved according to the same photographic transparency. On comparison, it is found that the individual protuberances of the laser gravure plate have smaller end faces which print later than the individual protuberances of the Nyloprint plate. In addition, the side walls of the protuberance in the laser gravure plate are steeper and the shadow dot wells are also considerably deeper than in the Nyloprint plate. In the print comparison diagram (printing characteristics) in FIG. 5, the percent dot area values and characteristics—DAT of the photographic transparency and DAP of the printed copy—for the Nyloprint plate (FIG. 3) and the laser gravure plate (FIG. 4) have been determined on one and the same printing press. It is found that, for example, a 20% DAP of the print is achieved for a 30% DAT of the film in the case of a laser gravure plate, whereas a 40% DAP of the print is obtained for the same 30% DAT of the film in the case of the Nyloprint plate. The printing characteristic for the laser gravure plate of FIG. 4 is thus considerably more advantageous than that for the Nyloprint plate, so that a high gain in contrast is achieved in conjunction with the possibility of reproducing finer contours and brightness and color steps. This results in considerable improvements in the print quality with less effort for laser gravure letterpress printing.

Improved tonal value transfer characteristics in multicolor halftone printing are therefore also achieved in indirect printing processes (dry offset), such as tube, cup and can printing.

Light halftone areas can be laser-treated with smaller plate thickness so that the specific pressure is reduced compared with solid areas. This pressure relief in the light halftone area leads to increased print contrast and hence to improved reproduction of tonal values.

The printing relief production by means of laser requires only a single setting of the pressure relief characteristics on the laser unit. The engraving to give the relief requires no labor. In contrast to the conventional relief production, labor is required in each process step (exposure, washing, drying, flash exposure). Only the drying and flash exposure can be automated by appropriate technology.

In summary, the present invention relates to a material for gravure recording by means of coherent electromagnetic radiation for letterpress printing, consisting of a substrate and a crosslinkable layer, with or without a release layer and/or cover sheet, the layer containing at least one ethylenically unsaturated compound and a polymerization initiator and at least one polymeric binder which consists of polyvinyl alcohol and/or at least one copolymer having a substantial proportion of the structure unit

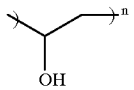

and containing a filler having a ceiling temperature of less than 800K, in particular less than 600K, e.g. polystyrene, polymethyl methacrylate, poly(ethylene)ketone, polyoxymethylene or poly(α-methylstyrene), in particular having a spherical or roughly spherical form with a maximum dimension of about 5–10 μm. The material is very suitable for laser-engravable letterpress printing plates.

We claim:

1. A material for gravure recording by means of coherent electromagnetic radiation, consisting essentially of A) a substrate, B) a crosslinkable layer, C) optionally a release layer and D) optionally a cover sheet, the crosslinkable layer B) containing B1) at least one ethylenically unsaturated compound and B2) a polymerization initiator and B3) at least one polymeric binder which consists of a polyvinyl alcohol having a degree of hydrolysis of 50–99% and/or one or more copolymers which have a specific proportion of the structural unit

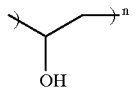

wherein

B4) a polymeric filler in particulate form which has a ceiling temperature of less than 800K, is additionally provided, and wherein said filler consists of one or more polymers selected from the group of polystyrene, polymethyl methacrylate (PMMA), poly(ethylene)ketone, polyoxymethylene (POM) and poly(α-methylstyrene).

2. A material as claimed in claim 1, wherein the polymeric filler is used in an amount of from 2 to 25% by weight, based on the solids content of the crosslinkable layer B).

3. A material as claimed in claim 1, wherein the polymeric filler has a ceiling temperature of less than 500K and is polymethyl methacrylate or polyoxymethylene.

4. A material as claimed in claim 1, wherein the crosslinkable layer (B) is crosslinked photochemically, thermally or by means of an electron beam before the gravure recording.

5. A material as claimed in claim 1, wherein one or more colorants, stabilizers or plasticizers are incorporated.

6. A material as claimed in claim 1, wherein the coherent electromagnetic radiation is laser radiation.

7. A material as claimed in claim 3, comprising precrosslinked polymer beads of PMMA as filler.

8. A material as claimed in claim 3, comprising uncrosslinked polymer particles of POM as filler.

9. A printing plate produced by laser engraving a material as claimed in claim 1 by means of a $CO_2$ laser.

10. A material as claimed in claim 1, wherein the polymeric filler has a ceiling temperature of less than 500K.

* * * * *